US008528969B2

(12) United States Patent
Huang

(10) Patent No.: US 8,528,969 B2
(45) Date of Patent: Sep. 10, 2013

(54) CLASS CHAIR

(76) Inventor: Tsung-Chieh Huang, Kaohsiung (TW)

( * ) Notice: Subject to any disclaimer, the term of this patent is extended or adjusted under 35 U.S.C. 154(b) by 0 days.

(21) Appl. No.: 13/244,935

(22) Filed: Sep. 26, 2011

(65) Prior Publication Data

US 2013/0076080 A1 Mar. 28, 2013

(51) Int. Cl.
*A47B 39/00* (2006.01)

(52) U.S. Cl.
USPC ..... 297/160; 297/162; 297/188.08

(58) Field of Classification Search
USPC ..... 297/160–162, 188.08, 449.1
See application file for complete search history.

(56) References Cited

U.S. PATENT DOCUMENTS 320,629 A * 6/1885 Closterman ..... 297/449.1
534,069 A * 2/1895 Howe ..... 297/449.1
549,708 A * 11/1895 Dennett ..... 297/449.1
611,882 A * 10/1898 Wisler ..... 297/452.11
864,347 A * 8/1907 Williams ..... 297/446.2
942,570 A * 12/1909 Lawrence ..... 297/449.1
1,664,103 A * 3/1928 Bishoff ..... 297/449.1
2,776,177 A * 1/1957 Vance ..... 297/170
3,497,262 A * 2/1970 Piretti Giancarlo et al. .. 297/239
3,567,284 A * 3/1971 Miller et al. ..... 297/451.1
3,768,863 A * 10/1973 Jennings ..... 297/451.1
3,847,432 A * 11/1974 Jennings ..... 297/160

* cited by examiner

*Primary Examiner* — David Dunn
*Assistant Examiner* — Alexander Harrison

(57) ABSTRACT

A class chair includes a chair frame, seat, and a table. A rack is arranged below the chair frame, and the seat is arranged to a top of the chair frame. A table retaining plate is formed to a lower lateral side of the chair frame so as to fix a linking plate of a table frame of the table. The class chair provides a steady and durable assembly. Through the removable table frame and the rack, the assembly of the chair frame and the seat can be piled on top of each other so as to save the space and cost of transportation and storing.

2 Claims, 6 Drawing Sheets

CLASS CHAIR

FIELD OF THE INVENTION

The present invention relates to class chair, and particular to a class chair having removable rack and table frame so that the rest of the class chair can be piled up for saving space and cost during a transportation or storing.

DESCRIPTION OF THE PRIOR ART

Prior class chair having linked table and chairs are mainly designed for purpose of steady, durability, and high economical benefit with lower cost for both user and manufacturer.

However, most of conventional class chairs are made by welding. The firmly structure by welding can provide steady and durability, but the transportation space will cause highly cost to manufacture.

For that reason, some foldable chairs are developed for the purpose of saving the space during transportation or storing as well as the cost. However, such design will suffer issue of shaking after long term usage. The steady, durability, and carrying ability of the chair are not acceptable by user.

Therefore, to provide a chair which can fulfill the need of small transportation space for lowering the cost and satisfy user's request of steady, durability, and capability of being piled up is an urgent quest for the business.

SUMMARY OF THE PRESENT INVENTION

Accordingly, the present invention is to provide a class chair having removable rack and table frame so that the rest of the class chair can be piled up for saving space and cost during a transportation or storing. The primary object of the present invention is listed in the following.

1. To provide a class chair can be piled up for saving space and cost during transportation for manufacturer.
2. To provide a class chair can be piled up for saving store space for manufacturer and user.
3. To provide a class chair with simple assembling, durability, and steady carrying ability.
4. To provide a class chair can be easily and quickly assembled and disassembled for usage, transportation, or stored by manufacturer or user.
5. To provide a class chair having highly industry utilization and economical benefit.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
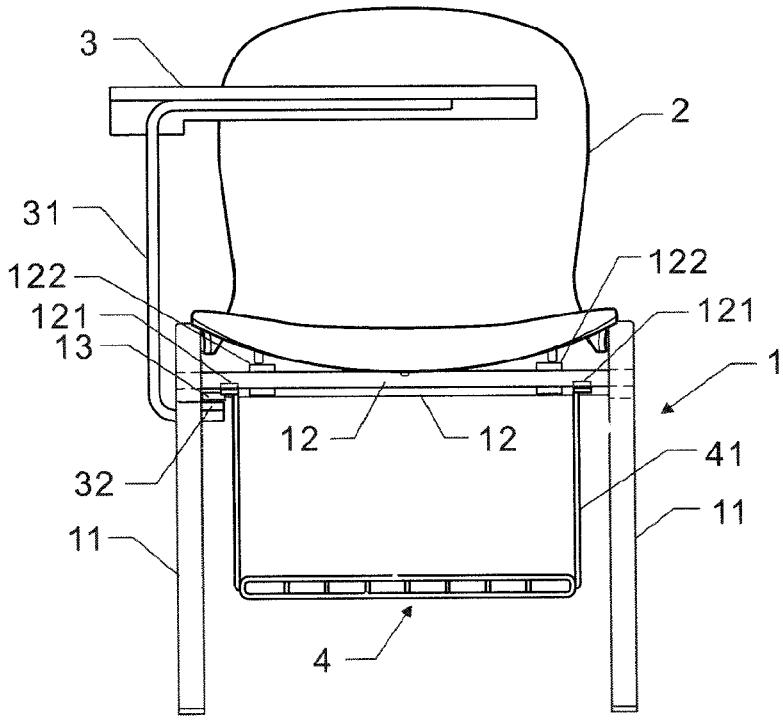
FIG. 1 is a front view of the present invention.
Figure 2:
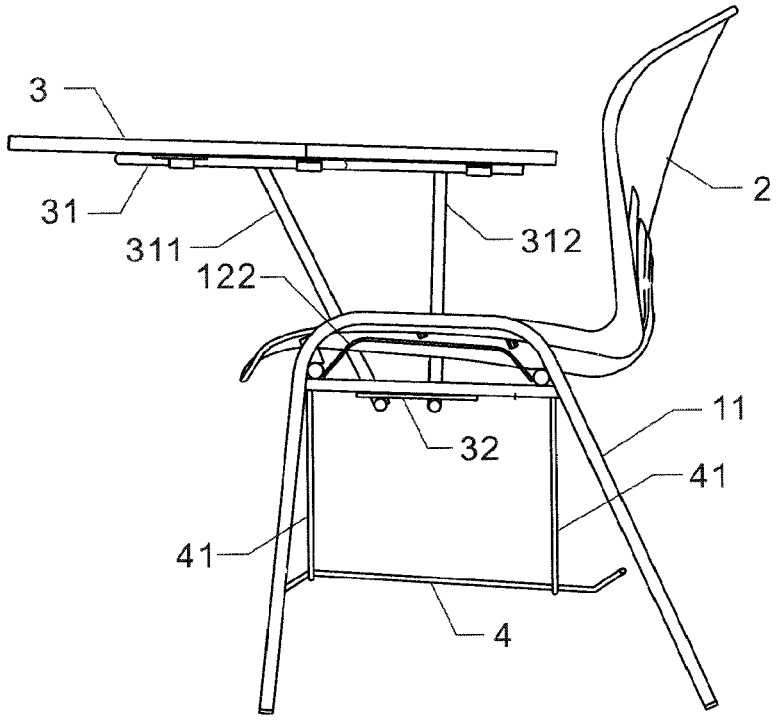
FIG. 2 is a side view from a right side of the present invention.
Figure 3:
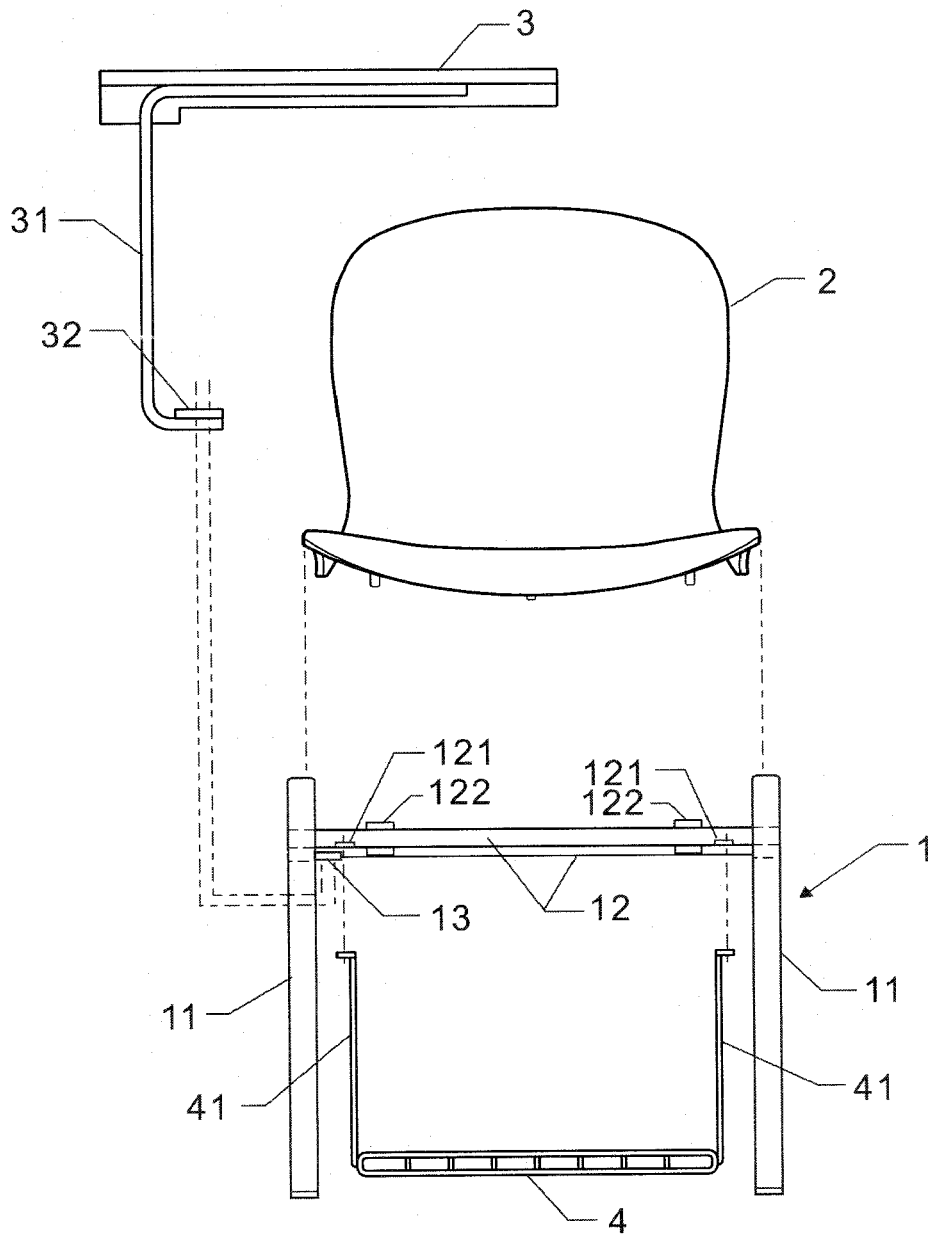
FIG. 3 is a schematic view showing the assembling of the present invention.
Figure 4:
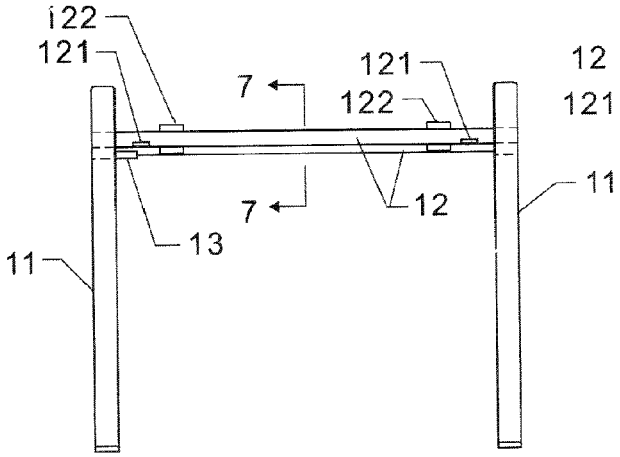
FIG. 4 is a front view of a chair frame of the present invention.
Figure 5:
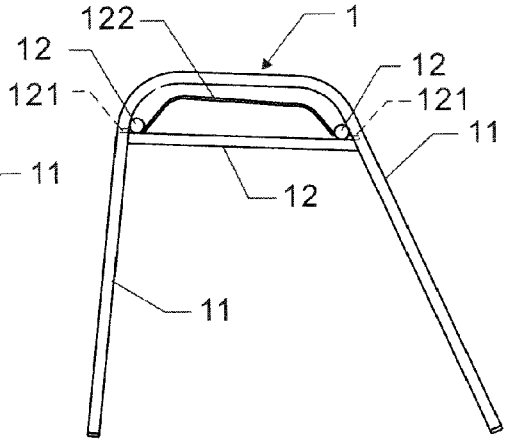
FIG. 5 is a side view from the right of the chair frame of the present invention.
Figure 6:
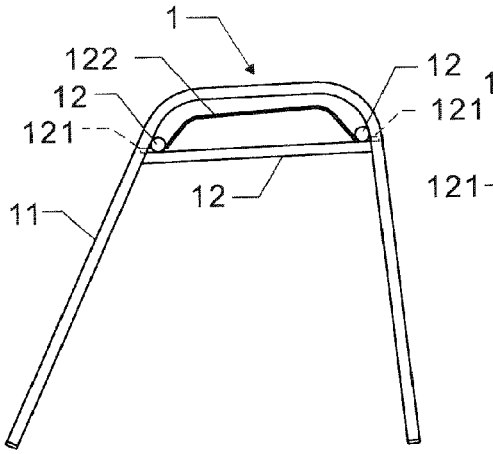
FIG. 6 is a side view from the left of the chair frame of the present invention.
Figure 7:
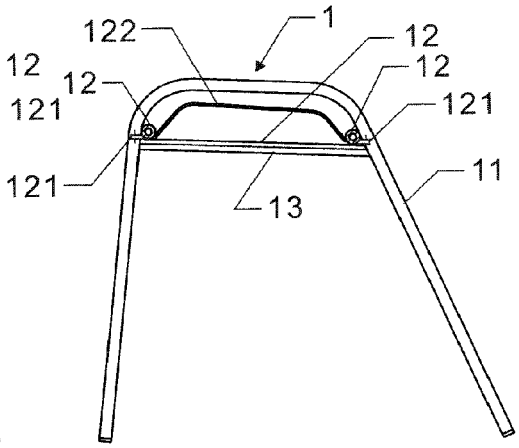
FIG. 7 is a cross-section view through a 7-7 line in FIG. 4.
Figure 9:
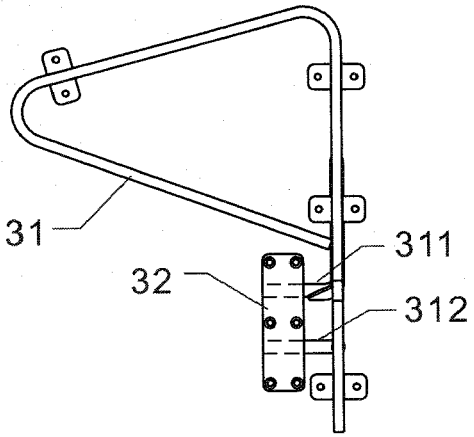
FIG. 9 is a top view showing the table frame of the present invention.
Figure 8:
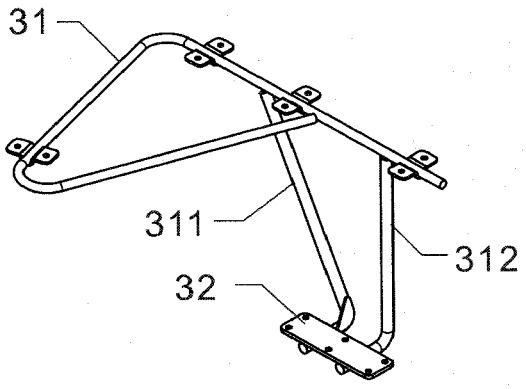
FIG. 8 is a schematic view showing a table frame of the present invention.
Figure 10:
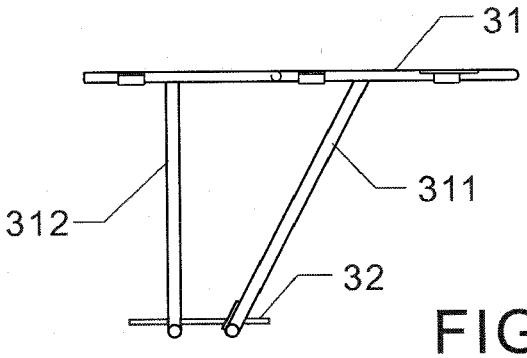
FIG. 10 is a side view from the right of the table frame of the present invention.
Figure 11:
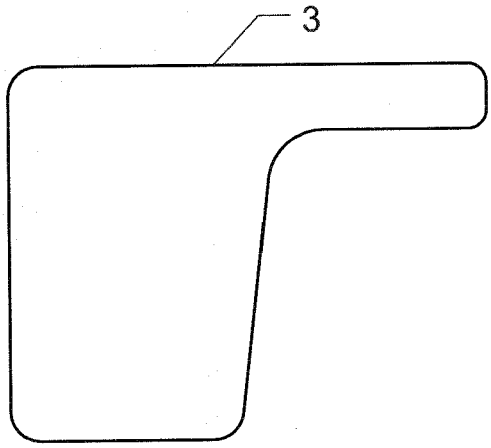
FIG. 11 is a schematic view showing a table plate of the present invention.
Figure 12:
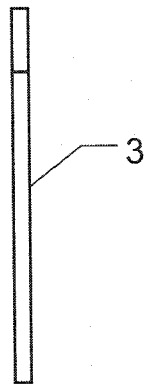
FIG. 12 is a side view from the right side of the table plate of the present invention.
Figure 15:
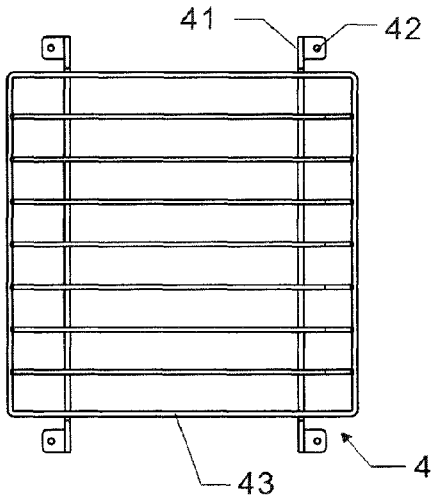
FIG. 15 is a top view showing the rack of the present invention.
Figure 13:
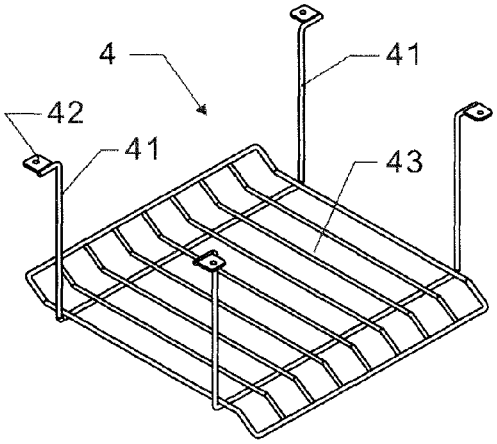
FIG. 13 is a schematic view showing a rack of the present invention.
Figure 14:
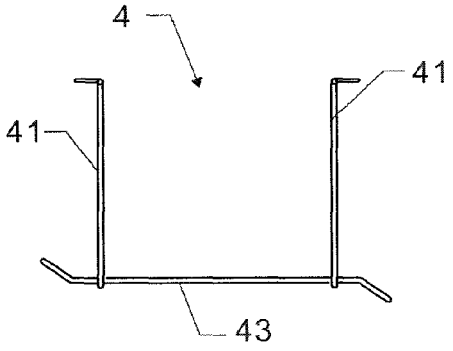
FIG. 14 is a side view from the left side of the rack of the present invention.
Figure 16:
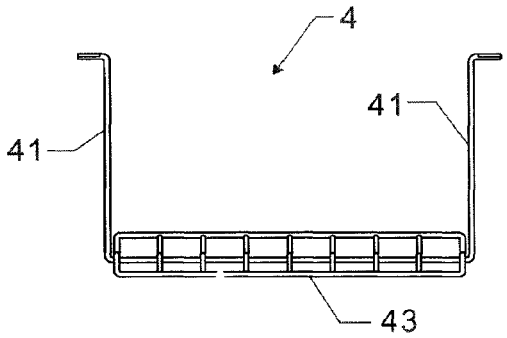
FIG. 16 is a side view from a right side of the rack of the present invention.

Referring to FIGS. 1 and 2, a preferable embodiment of a class chair according to the present invention is illustrated. The class chair includes a chair frame 1, seat 2, and a table 3. Referring to FIGS. 4 to 7, the chair frame 1 has two curved foot frames 11 linking by four linking pipes 12 on upper portions of the foot frames 11. Each foot frame 11 has two feet so that the chair frame 1 can stand still on the floor by four feet. The seat 2 is arranged to the chair frame 1. A predetermined gap is formed between the linking pipes 12 to the tops of the foot frames 11. The gap provides room for assembling a rack 4 and a table support 31 of the table 3.

The linking pipe 12 has threaded holes 121 for fixing the rack 4. Two support branches 122 are arranged between the front and the rear linking pipes 12. A table retaining plate 13 is fixed to an inner side of one of the two lateral linking pipes 12. The table retaining plate 13 has threaded hole for fixing a linking plate 32 of the table support 31.

Referring to FIGS. 8 to 12, the table frame 31 has a horizontal frame on top for arranging the table 3 and two supports 311 and 312 extending downward from the horizontal frame. The support 311 is not perpendicular to the horizontal frame, while the support 312 is perpendicular to the horizontal frame. The bottom ends of the two supports 311 and 312 are linked by a linking plate 32. Threaded holes corresponding to the chair frame 1 are formed to the linking plate 32.

Referring to FIGS. 13 to 16, the rack 4 has four linking rods 41 extending upward. An assembling hole 42 opposite to the threaded hole 121 is formed to an upper end of the linking rod 41 so that the rack 4 can be arranged below the chair frame 1. A front side of the rack 4 is downward inclined with a predetermined angle for conveniently receiving stuffs or being stepped by user's feet. A rear side thereof is upward inclined so as to prevent stuffs from dropping out of the rack 4.

Figure 17:
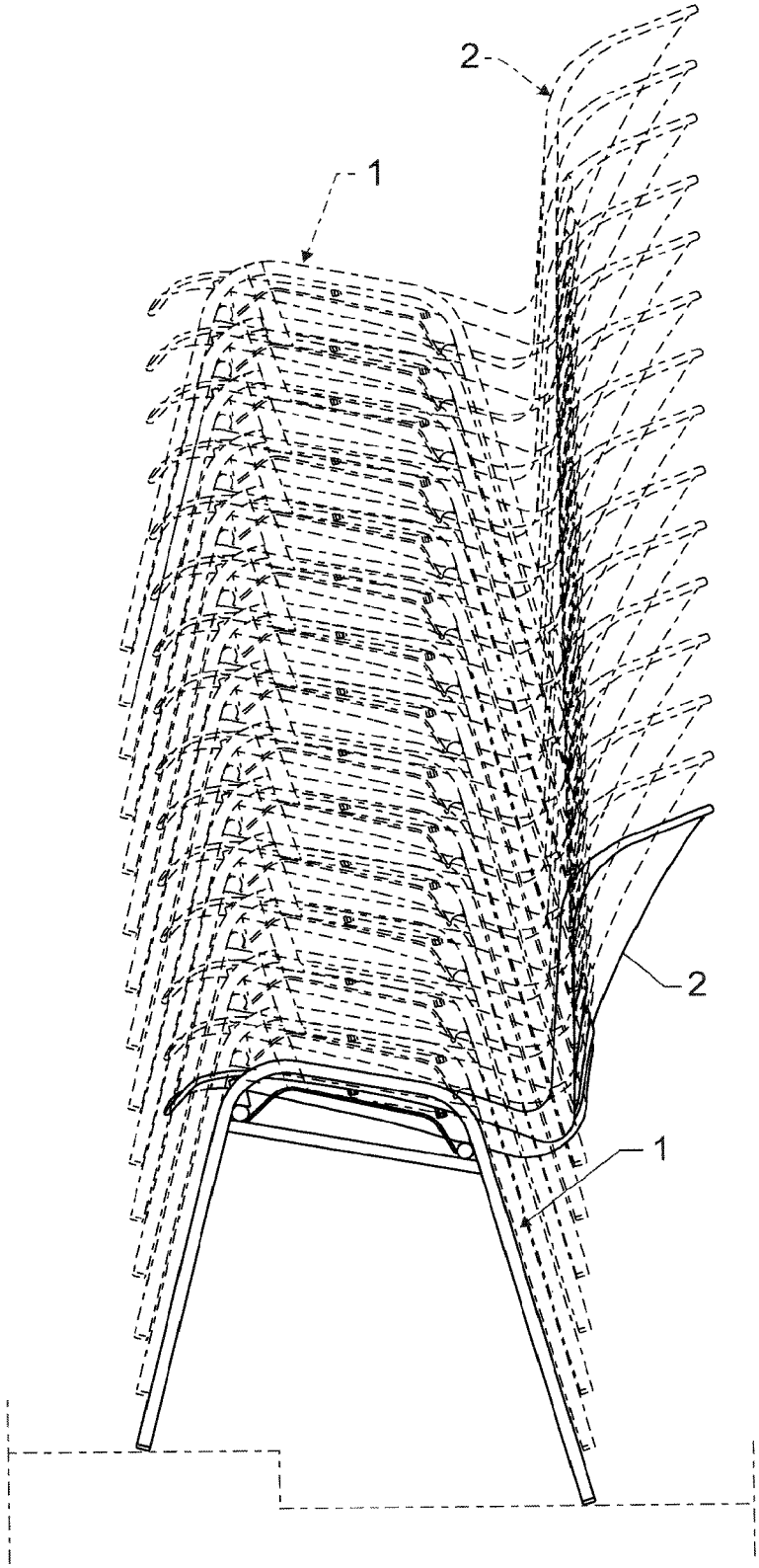
FIG. 17 is a schematic view showing the piling of the present invention.

Through the removable table frame and the rack, the rack and the table frame can be piled and packed separately during stock, transportation, or putting away by user. The assembly of the chair frame and the seat can be piled on top of each other so as to save the space and cost efficiently as shown in FIG. 17. The class chair can also provide a steady and durable assembly to the user.

Therefore, the class chair of the present invention can achieve the following advancement.

1. The class chair can be piled up to save the transportation space and cost for manufacturer.

2. The class chair can be piled up to save the storing space for manufacturer or user.

3. Simple assembling, durability, and steady carrying are achieved.

4. The class chair can be easily and quickly assembled and disassembled for usage, transportation, or stored by manufacturer or user.

5. Highly industry utilization and economical benefit are achieved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A class chair comprising:

a chair frame having two curved leg frames linking by four linking pipes on upper portions of the foot frames; two support branches being arranged between a front one of the four linking pipes and a rear one of the four linking pipes; each foot frame having two feet so that the chair frame will stand still on the floor by four feet; a predetermined gap between the linking pipes to the tops of the foot frame providing room for assembling; the front one of the linking pipes and the rear one of the linking pipes having a plurality of threaded holes; a table retaining plate being fixed to an inner side of one of the two lateral linking pipes;

a seat arranged to the chair frame;

a table having a table frame; the table frame having a horizontal frame on top for arranging a table plate and two supports extending downward from the horizontal frame; the bottom ends of the two supports being linked by a linking plate;

wherein a rack is fixed to the chair frame through the threaded holes of the front and the rear linking pipes; the linking plate is fixed to the table retaining plate of the chair frame; and wherein the rack has four linking rods extending upward; an assembling hole is formed to an upper end of each linking rod so that the rack is arranged to the front and rear linking pipes of the chair frame; a front side of the rack is downward inclined with a predetermined angle and a rear side thereof is upward inclined.

2. The class chair as claimed in claim 1, wherein a front one of the two supports is not perpendicular to the horizontal frame, and a rear one of the two supports is perpendicular to the horizontal frame.

* * * * *